US008225879B2

(12) United States Patent
Dietz, Jr. et al.

(10) Patent No.: US 8,225,879 B2
(45) Date of Patent: Jul. 24, 2012

(54) RAM BLOWOUT PREVENTER STROKE LIMITING AND METHOD

(75) Inventors: David A. Dietz, Jr., Tomball, TX (US); Greg Landthrip, Katy, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 310 days.

(21) Appl. No.: 12/625,792

(22) Filed: Nov. 25, 2009

(65) Prior Publication Data

US 2011/0120734 A1 May 26, 2011

(51) Int. Cl.
*E21B 33/06* (2006.01)

(52) U.S. Cl. ..... 166/387; 166/85.4

(58) Field of Classification Search ..... 166/387, 166/85.4; 251/1.1, 1.2, 1.3
See application file for complete search history.

(56) References Cited

U.S. PATENT DOCUMENTS 5,653,418 A * 8/1997 Olson ..... 251/1.3
6,969,042 B2 * 11/2005 Gaydos ..... 251/1.3
* cited by examiner

*Primary Examiner* — William P Neuder
(74) *Attorney, Agent, or Firm* — Potomac Patent Patent Group PLLC

(57) ABSTRACT

Method and blowout preventer for sealing a well. The blowout preventer includes a body having first and second chambers, the first chamber extending substantially perpendicular to and intersecting the second chamber; first and second ram blocks configured to move within the first chamber to seal a first region of the second chamber from a second region of the second chamber; first and second rods connected to the first and second ram blocks, respectively, and configured to extend along the first chamber; first and second bonnets partially covering first and second rods, respectively, the bonnets being detachably attached to the body; and first and second stroke limiting devices configured to pierce through end parts of the first and second bonnets and limit a stroke of the first and second rods by a predetermined amount.

20 Claims, 9 Drawing Sheets

RAM BLOWOUT PREVENTER STROKE LIMITING AND METHOD

BACKGROUND

1. Technical Field

Embodiments of the subject matter disclosed herein generally relate to methods and systems and, more particularly, to mechanisms and techniques for reducing a stroke of a ram block in a ram blowout preventer.

2. Discussion of the Background

During the past years, with the increase in price of fossil fuels, the interest in developing new production fields has increased dramatically. However, the availability of land-based production fields is limited. Thus, the industry has now extended drilling to offshore locations, which appear to hold a vast amount of fossil fuel.

The existing technologies for extracting the fossil fuel from offshore fields use a system 10 as shown in FIG. 1. More specifically, the system 10 includes a vessel 12 having a reel 14 that supplies power/communication cords 16 to a controller 18. The controller 18 is disposed undersea, close to or on the seabed 20. In this respect, it is noted that the elements shown in FIG. 1 are not drawn to scale and no dimensions should be inferred from FIG. 1.

FIG. 1 also shows a wellhead 22 of the subsea well and a drill line 24 that enters the subsea well. At the end of the drill line 24 there is a drill (not shown). Various mechanisms, also not shown, are employed to rotate the drill line 24, and implicitly the drill, to extend the subsea well.

However, during normal drilling operation, unexpected events may occur that could damage the well and/or the equipment used for drilling. One such event is the uncontrolled flow of gas, oil or other well fluids from an underground formation into the well. Such event is sometimes referred to as a "kick" or a "blowout" and may occur when formation pressure inside the well exceeds the pressure applied to it by the column of drilling fluid. This event is unforeseeable and if no measures are taken to prevent it, the well and/or the associated equipment may be damaged. Although the above discussion was directed to subsea oil exploration, the same is true for ground oil exploration.

Thus, a blowout preventer (BOP) might be installed on top of the well to seal the well in case that one of the above mentioned events is threatening the integrity of the well. The BOP is conventionally implemented as a valve to prevent the release of pressure either in the annular space between the casing and the drill pipe or in the open hole (i.e., hole with no drill pipe) during drilling or completion operations. Recently, a plurality of BOPs may be installed on top of the well for various reasons. FIG. 1 shows two BOPs 26 or 28 that are controlled by the controller 18.

A traditional BOP may be one to five meters high and may weight tens of thousands of kilograms. Various components of the BOP need to be replaced from time to time. An example of a BOP 26 is shown in FIG. 2. The BOP 26 shown in FIG. 2 has, among other things, two ram blocks 30 that are supported by respective piston rods 32 and a corresponding locking mechanism 33, which is configured to lock the rods 32 at desired positions. The two ram blocks 30 are configured to move inside a first chamber 34 (horizontal bore) along a direction parallel to a longitudinal axis X of the piston rods 32. The ram blocks 30 may severe the drill line 24 or other tools that cross a second chamber 36 (vertical wellbore) of the BOP 26. First and second chambers are substantially perpendicular to each other. However, after cutting the drill line 24 for a number of times (if a shear ram block is installed), the ram blocks 30 and/or their respective cutting edges need to be verified and sometimes reworked. For this reason, the BOP 26 of FIG. 2 is provided with a removable bonnet 38, for each ram block 30, which can be opened for providing access to the ram blocks. FIG. 2 shows the bonnet 38 having a hinge 40 that rotatably opens the bonnet 38.

FIG. 3 shows the BOP 26 having the bonnet 38 opened so as to expose the ram block 30. Thus, in order to perform maintenance on the ram block 30, the bonnet 38 needs to be opened while the ram block 30 is placed at a certain position, so that the bonnet may open freely without interfering with BOP 26. This specific position of the ram block 30 that allows the bonnet 38 to open does not coincide with a functional open position of the ram block, i.e., a position that allows tools to enter through the second chamber 36. The specific position of the ram block 30 corresponds to the ram block being further withdrawn inside the bonnet 38 as the ram block needs to swing with the bonnet 38 around hinge 40 without touching a side 42*a* of a body 42 of the BOP 26. In other words, the ram block 30 may have a functional open position when the bonnet 38 is closed and the ram block is operational and a maintenance open position when the bonnet 38 has to be opened. These two positions do not coincide for the traditional BOPs. The traditional BOPs are using the maintenance opened position for both when the ram block is operational and when the bonnet has to be opened. This design is making the BOPs to use a fluid under pressure (for opening/closing the ram blocks) more than necessary.

Therefore, it is desired to provide a novel BOP that uses the correct amount of fluid under pressure, which makes the operation of the BOP faster and more cost-effective.

SUMMARY

According to one exemplary embodiment, there is a blowout preventer for sealing a well. The blowout preventer includes a body having first and second chambers, the first chamber extending substantially perpendicular to and intersecting the second chamber and also intersecting the second chamber; first and second ram blocks configured to move within the first chamber to seal a first region of the second chamber from a second region of the second chamber; first and second rods connected to the first and second ram blocks, respectively, and configured to extend along the first chamber; first and second bonnets partially covering first and second rods, respectively, the bonnets being detachably attached to the body; and first and second stroke limiting devices configured to pierce through end parts of the first and second bonnets and to limit a stroke of the first and second rods by a predetermined amount.

According to another exemplary embodiment, there is a blowout preventer for sealing a well. The blowout preventer includes a body having first and second chambers, the first chamber extending substantially perpendicular to and intersecting the second chamber; first and second ram blocks configured to move within the first chamber to seal a first region of the second chamber from a second region of the second chamber; first and second rods connected to the first and second ram blocks, respectively, and configured to extend along the first chamber; first and second bonnets partially covering the first and second rods, respectively, the first and second bonnets being detachably attached to the body; first and second stroke limiting devices configured to pierce through end parts of the first and second bonnets and limit a stroke of the first and second rods by a predetermined amount; an opening chamber and a closing chamber in each of the first and second bonnets; and a piston in each of the first and second bonnets separating corresponding opening and closing chambers and configured to be fixedly attached to a corresponding rod of the first and second rods such that when a differential pressure between the corresponding opening chamber and the corresponding closing chamber is positive the piston moves integrally with the corresponding rod to open the corresponding ram block and when the differential pressure is negative, the piston moves integrally with the corresponding rod to close the corresponding ram block. A movement of the corresponding rod to open the corresponding ram block is limited by the corresponding stroke limiting device, which defines an opened functional position of the ram blocks.

According to still another exemplary embodiment, there is a method for reducing a stroke of a blowout preventer for sealing a well. The method includes a step of providing stroke limiting devices through end parts of bonnets of a body of the blowout preventer; a step of applying an opening pressure to move ram blocks from a closed position to an opened functional position inside the body; and a step of limiting a movement of rods attached to the ram blocks with stroke limiting devices such that the ram blocks do not reach an opened maintenance position, which is used to open bonnets of the blowout preventer for reaching the ram blocks.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a ram BOP provided on top of a well head undersea. However, the embodiments to be discussed next are not limited to these systems, but may be applied to other BOPs that may be used, for example, inland.

Reference throughout the specification to "an exemplary embodiment" or "another exemplary embodiment" means that a particular feature, structure, or characteristic described in connection with an embodiment is included in at least one embodiment of the subject matter disclosed. Thus, the appearance of the phrases "in an exemplary embodiment" or "in another exemplary embodiment" in various places throughout the specification is not necessarily referring to the same embodiment. Further, the particular features, structures or characteristics may be combined in any suitable manner in one or more embodiments.

According to an exemplary embodiment, a new or an existing blowout preventer (BOP) may be configured to reduce a stroke of a ram block when operational and to use a full stroke when the bonnet needs to be opened. In this way, a functional stroke of the ram block may be reduced by, for example, approximately 20% comparative to a traditional stroke for the same BOP. The reduction in stroke of the ram block determines a reduction in the amount of fluid necessary to be applied to the BOP to open and close the ram blocks, which results in less accumulator bottles. According to an estimate for a specific BOP, assuming that the stroke of the ram block is reduced by 20%, a number of accumulator bottles may be reduced from 14 to 11. Given the fact that each bottle has a volume of 160 gallons and a weight of approximately 10,000 lb, a BOP stack provided with the reduced stroke ram block may weight 30,000 lb less than the traditional BOP and this involves a cost reduction in the range of half a million dollars. Thus, a BOP having ram blocks with a reduced stroke but still fully operational result in a large mass reduction, cost savings, and reduced real estate of the BOP stack, all being desired features for these products.

Figure 1:
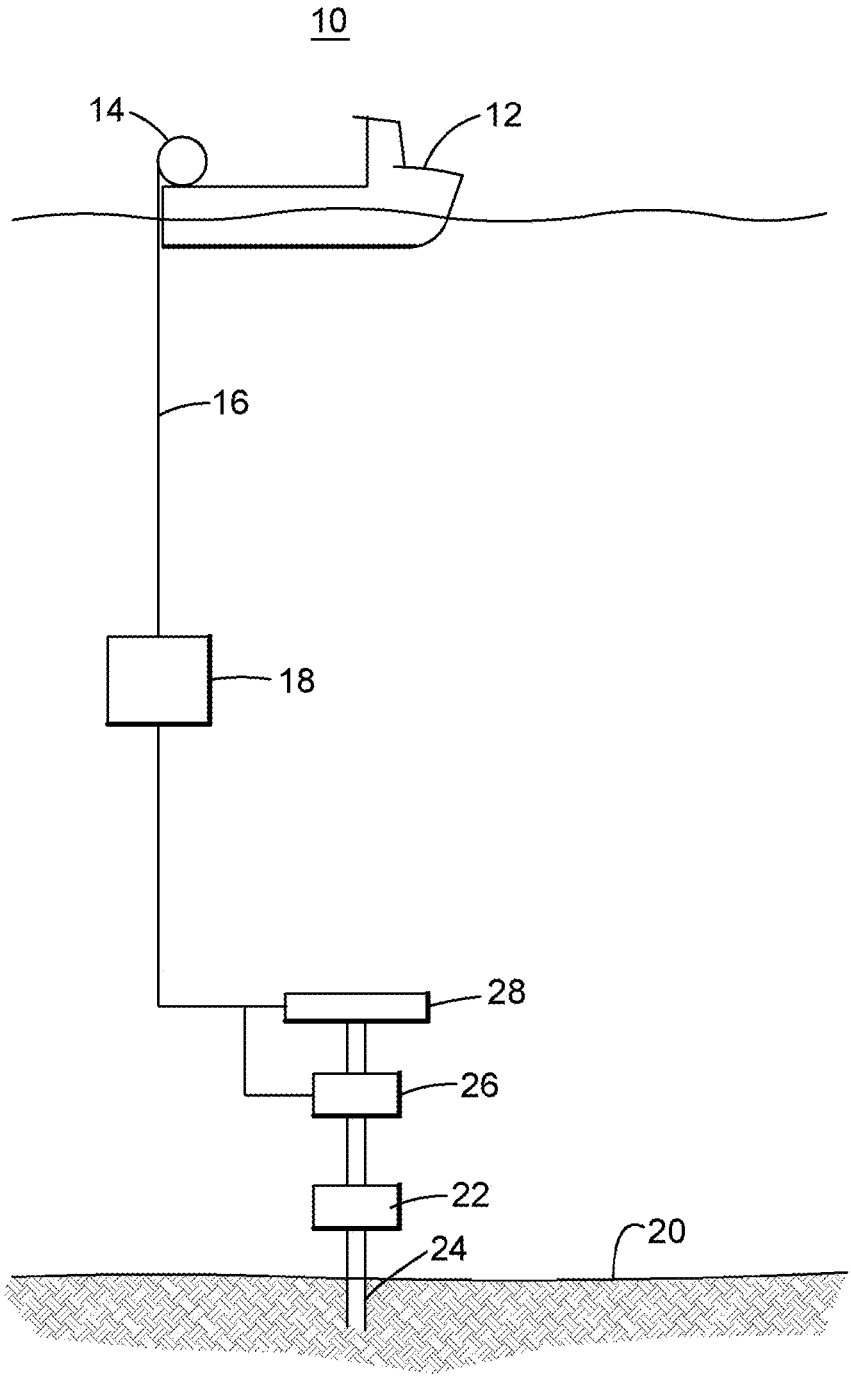
FIG. 1 Background Art
FIG. 1 is a schematic diagram of a conventional offshore rig.
Figure 2:
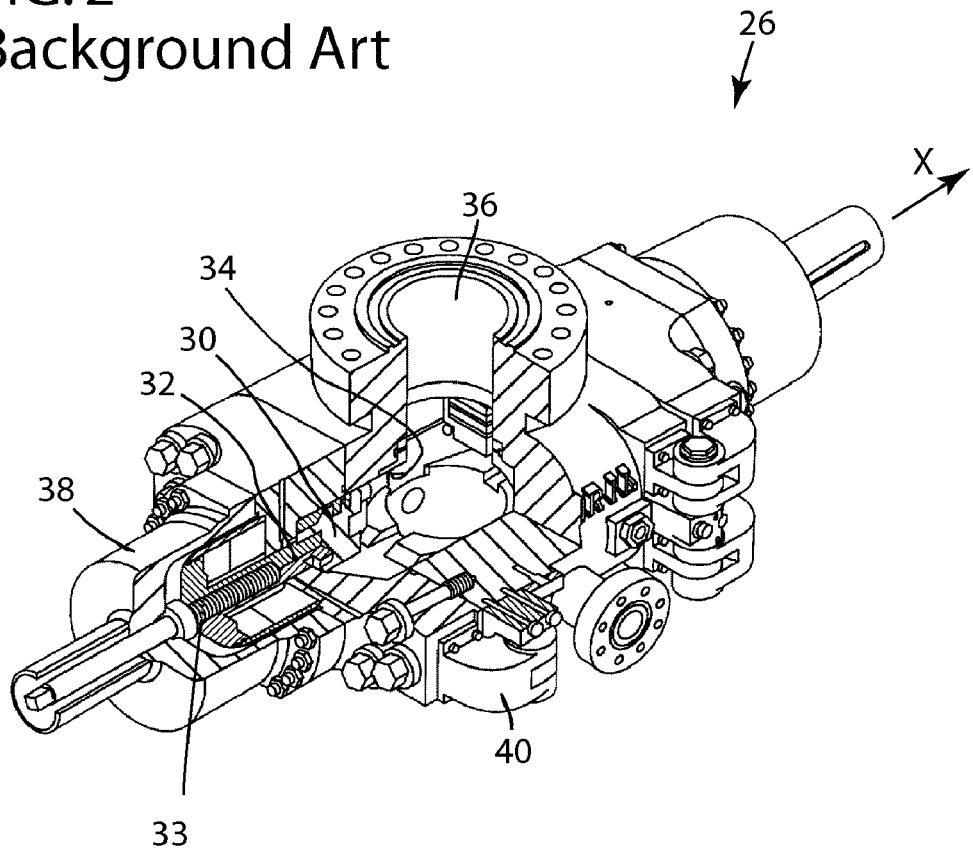
FIG. 2 Background Art
FIG. 2 is a schematic diagram of a traditional BOP.
Figure 3:
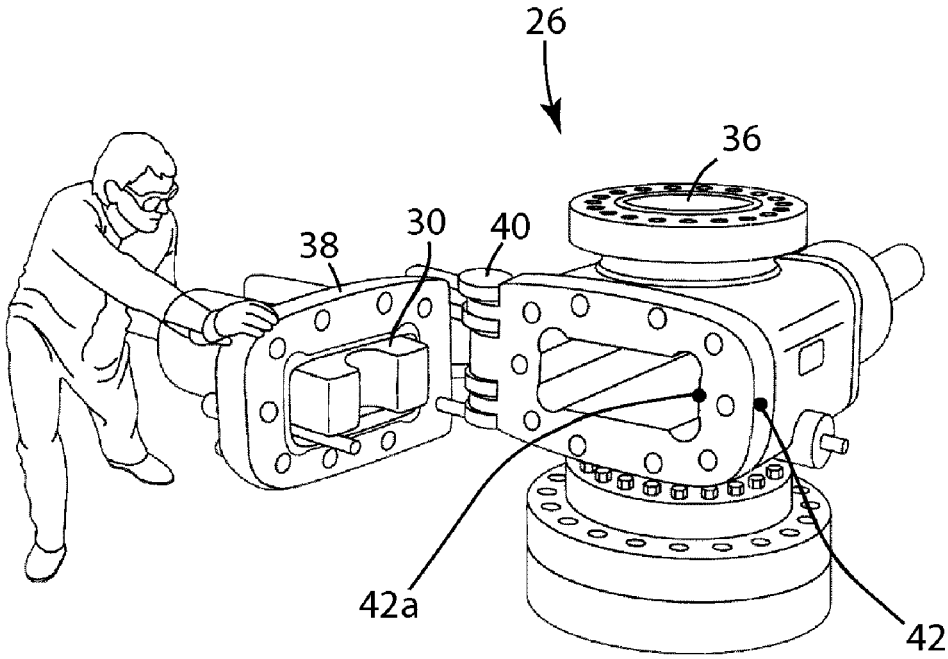
FIG. 3 Background Art
FIG. 3 is a schematic diagram of an opened BOP.
Figure 4:
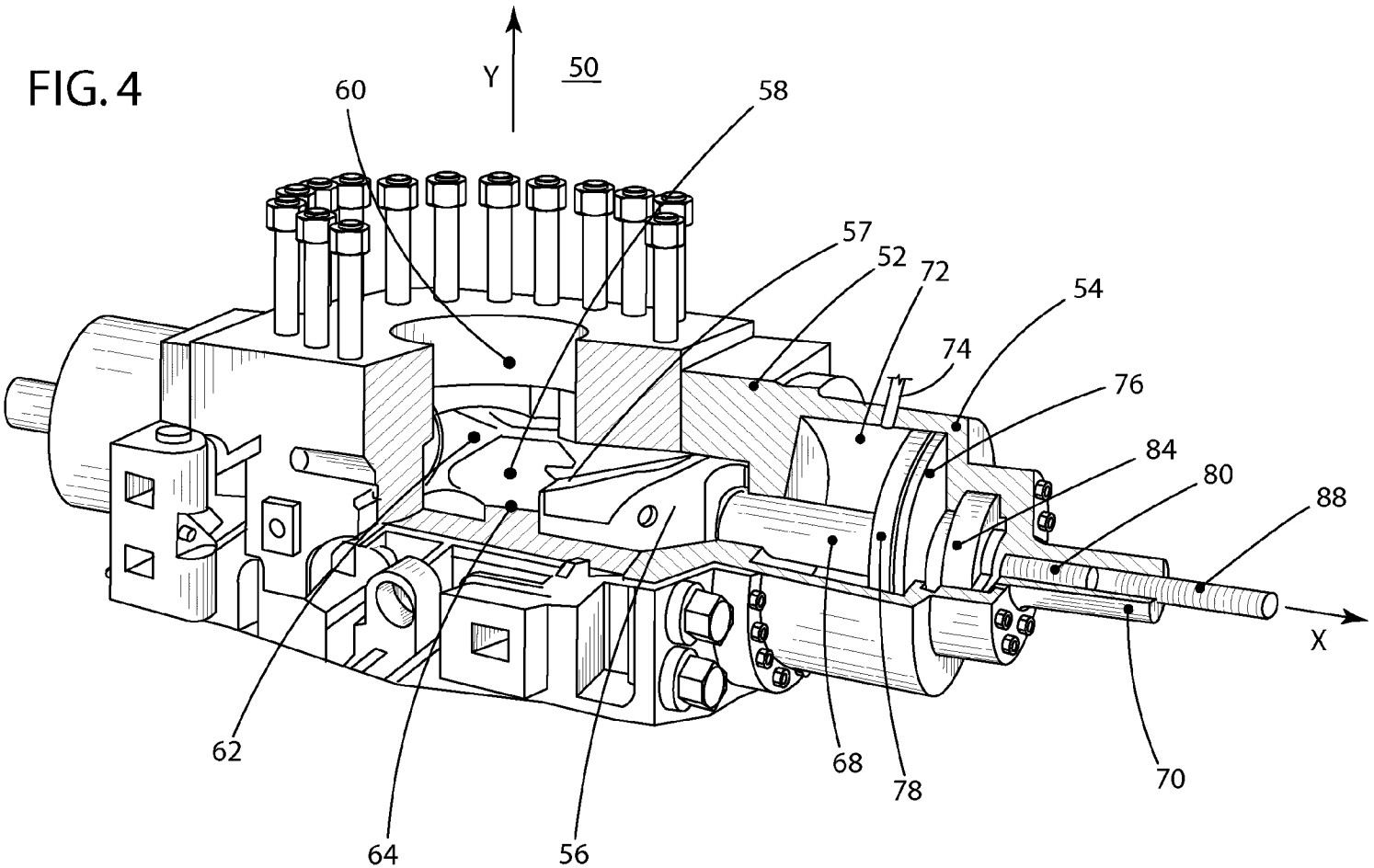
FIG. 4 is a schematic diagram of a BOP with stroke limiting devices according to an exemplary embodiment.

According to an exemplary embodiment shown in FIG. 4, a BOP 50 has a body 52 to which bonnets 54 may be attached. A pressure applied inside the bonnets may be between 5,000 and 15,000 psi. Body 52 includes a first chamber 57 that extends along an axis X and accommodates ram blocks 56. The ram blocks 56 are configured to move towards a central region 58 of the body 52, to seal a first portion 60 of a second chamber 62 from a second portion 64. The second chamber 62 extends along an axis Y, which is perpendicular to axis X. The first portion 60 may extend along the Y axis, upwards from the ram block 56 and the second portion 64 may extend along the Y axis, downwards from the ram block 56.

Ram blocks 56 may be connected to rods 68, which are configured to extend along the bonnet 54 and move toward corresponding end parts 70 of the body 52. End parts 70 may be caps (cylinders) that close bonnets 54 so that a working fluid present inside the body 52 does not escape into the environment, outside the body 52. Rods 68 extend through an opening chamber 72, which is formed inside bonnet 54. The opening chamber 72 may have at least one port 74 for receiving a fluid under pressure. Opening chamber 72 is separated from a closing chamber 76 by a piston 78. Piston 78 is attached or made integrally with rod 68 such that the two elements move together. When the fluid under pressure enters via port 74 to opening chamber 72, piston 78 moves from left to right in the figure, along axis X, thus moving the ram block 56 from a closed position to an opened position. When the piston 78 has moved to the right, the opening chamber 72 has a maximum volume and the closing chamber 76 has a minimum volume. The reverse action happens when a fluid at high pressure is provided in the closing chamber 76 and the piston 78 moves from right to left along axis X, thus closing the ram blocks 56.

An extension rod 80 extends from piston 78 along the axis X towards the end part 70. The extension rod 80 may be attached to piston 78 or made integrally with the piston 78. According to an exemplary embodiment, the rod 68, piston 78 and the extension rod 80 are integrally made. A locking mechanism 84 may be provided inside bonnet 54 but outside the closing chamber 76 for locking the extension rod 80 (and implicitly the rod 68) on a desired position. First and second stroke limiting devices 88 (only one stroke limiting device is shown in the figures) are configured to pierce through the end parts 70 of the bonnets 54 and limit a stroke of the first and second rods 68 by a predetermined amount.

Figure 5:
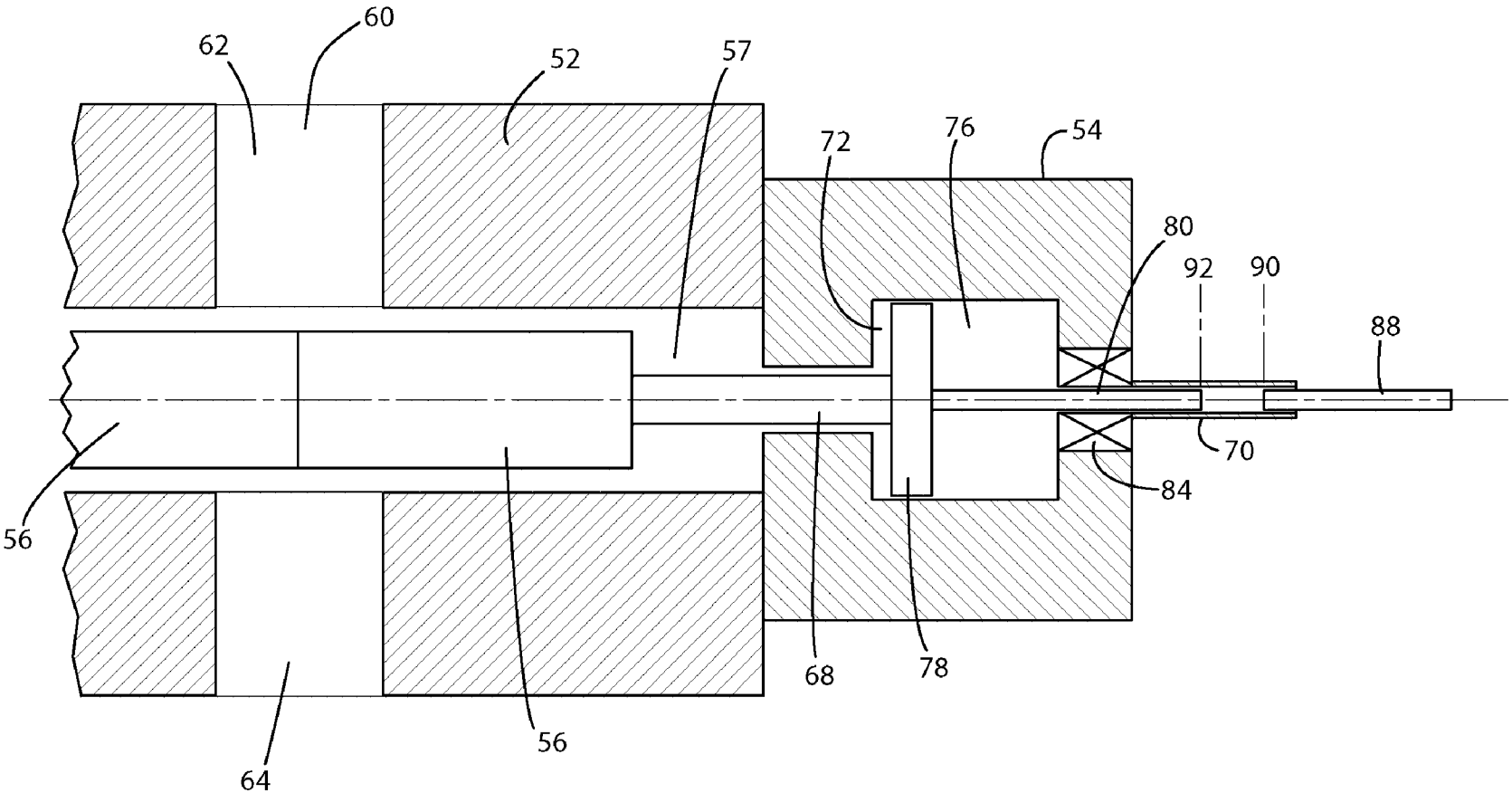
FIG. 5 is a schematic diagram of a BOP with ram blocks in a closed position according to an exemplary embodiment.
Figure 6:
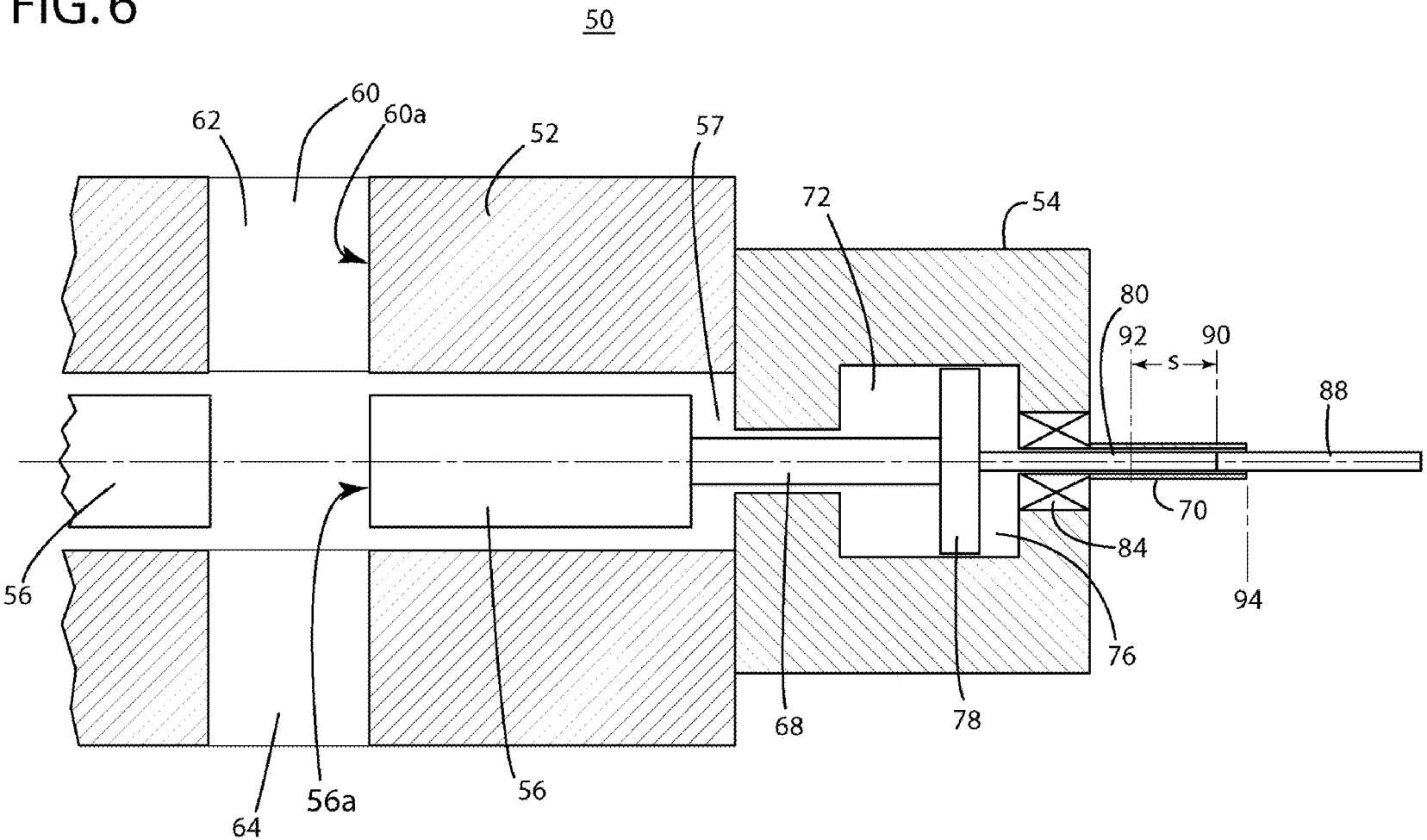
FIG. 6 is a schematic diagram of a BOP with ram blocks in an opened functional position according to an exemplary embodiment.

According to an exemplary embodiment illustrated in FIG. 5, the stroke limiting device 88 affects a stroke of the ram block 56 depending on the positioning of the stroke limiting device 88. Stroke limiting device 88 determines a position 90 beyond which the extension rod 80 cannot move. This position 90 is called opened functional position of the ram block 56. In this respect, it is noted that FIG. 5 does not show the ram block 56 at the opened functional position 90. FIG. 5 shows the ram blocks 56 being closed, i.e., the ram blocks separating the second chamber 60 into first and second regions 62 and 64. Thus, FIG. 5 shows the ram blocks at the closed position 92. FIG. 6 shows the same configuration as in FIG. 5 but with the ram blocks at the opened functional position 90, i.e., a stroke of the extension rod 80 being limited by the stroke limiting device 88. According to an exemplary embodiment, as the stroke limiting device 88 limits the movement of piston 78, the closing chamber 76 is prevented to achieve a substantially zero volume, as the traditional BOPs do (see FIG. 6).

Figure 7:
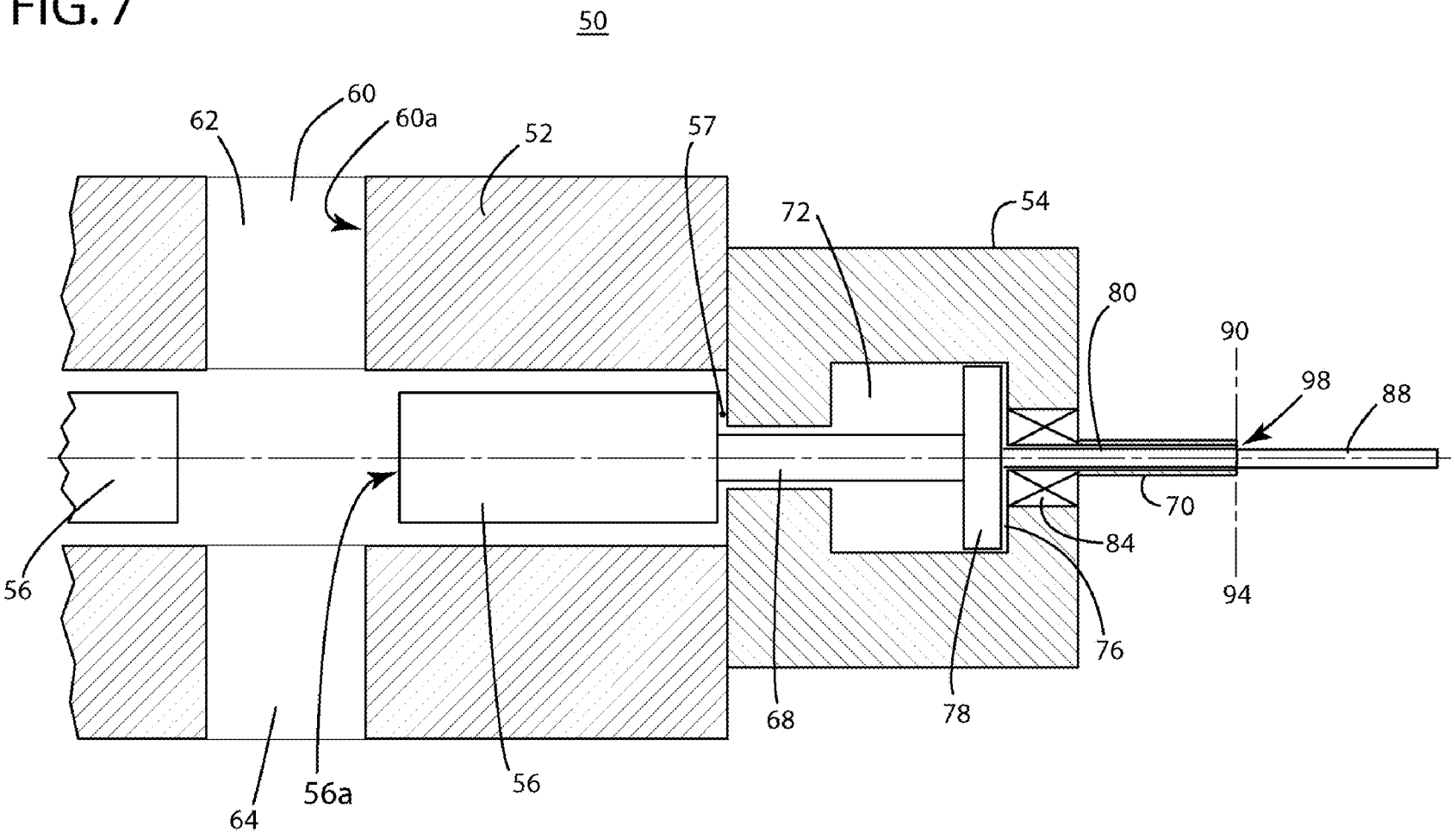
FIG. 7 is a schematic diagram of a BOP with ram blocks in an opened maintenance position according to an exemplary embodiment.

According to the exemplary embodiment shown in FIGS. 5 and 6, the stroke S of the ram block 56 is defined by the closed position 92 and the opened functional position 90. In a traditional BOP, the open position is indicated by reference sign 94. Thus, due to the stroke limiting device 88, the stroke S of the novel BOP is reduced, for example, by approximately 20% of the traditional stroke. In one application the reduction in stroke may be between 10% and 20%. It is noted that at the opened functional position 90 the ram block 56 is withdrawn inside chamber 57 such that a side 56*a* of the ram block 56 is flush with a side 60*a* of the second chamber 60. In contrast, FIG. 7 shows the same BOP 50 with the stroke limiting device 88 completely retrieved from an inside of the end part 70 (the stroke limiting device 88 is still connected to the end part 70 but does not limit the movement of extension rod 80). In this case, the open position of the ram blocks 56 is defined by face 56*a* of the ram block 56 being completely inside the first chamber 57 and the extension rod 80 being in direct contact with a distal portion 98 of the end part 70. The extension rod 80 may be or not in direct contact with stroke limiting device 88 when the stroke limiting device 88 is completely retrieved from an inside of the end part 70. Position 94 defines this opened position of the BOP without the stroke limiting device 88. In this particular case, the opened functional position 90 coincides with position 94, as in a traditional BOP.

According to the example shown in FIG. 7, the opened functional position of the ram block 56 coincides with an opened maintenance position 94, i.e., a position at which the ram block should be in order to be able to open bonnet 54. FIGS. 5, 6, and 7 are not at scale and their purpose is to illustrate relative positions of the ram blocks 56 in a BOP with and without a stroke limiting device 88.

With regard to FIG. 6, it is noted that the opened functional position 90 of the ram block 56 is different from the opened maintenance position 94 and this difference results in less pressure being necessary to open and close the ram blocks, which results in less accumulators bottles being necessary, which also results in a lighter and reduced overall cost BOP stack. The difference between the stroke S of the BOP with the stroke limiting device 88 inserted inside the end part 70, as shown in FIG. 6, and the stroke of the BOP with the stroke limiting device 88 completely retrieved from the inside of the end part 70, as shown in FIG. 7, is the difference in positions 90 and 94 in FIG. 6. In an exemplary embodiment, this difference may be about 20% of the stroke of the BOP without the stroke limiting device 88.

Figure 8:
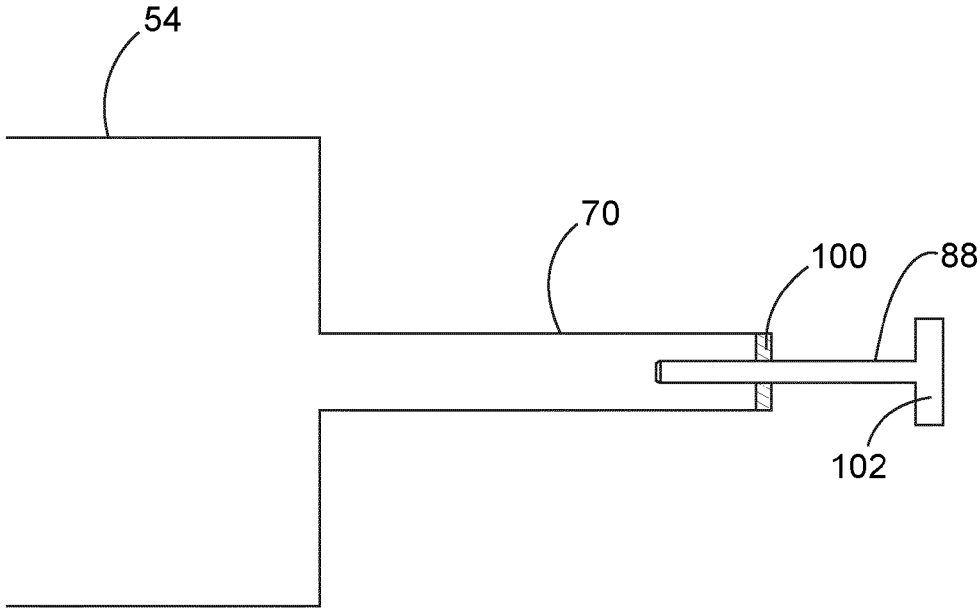
FIG. 8 is schematic diagram of a stroke limiting device according to an exemplary embodiment.

Stroke limiting device 88 may be implemented as a steel (or other resistant materials) bar attached to the end part 70 so that the steel bar pierces the bonnet 54. To prevent a loss of fluid from the bonnet 54, a seal 100 may be installed around the stroke limiting device 88 as shown in FIG. 8. The stroke limiting device 88 may be attached to the end portion 70 as known in the art, for example, by using a screw tread. Other mechanism may be used as would be appreciated by those skilled in the art. The stroke limiting device 88 may have a handle 102 so that an operator may manually adjust a position of the stroke limiting device 88 inside the end part 70. Alternatively or in addition, a hydraulic function may be used instead of the handle 102 for adjusting a position of the stroke limiting device 88 inside end part 70. The stroke limiting device 88 needs to be adjusted when it is decided to open the bonnet 54, so that the ram blocks are further retrieved to position 94 in FIG. 6. In accordance with an exemplary embodiment, traditional BOPs may be retrofitted with the stroke limiting device 88 shown in FIGS. 5 and 6.

Figure 9:
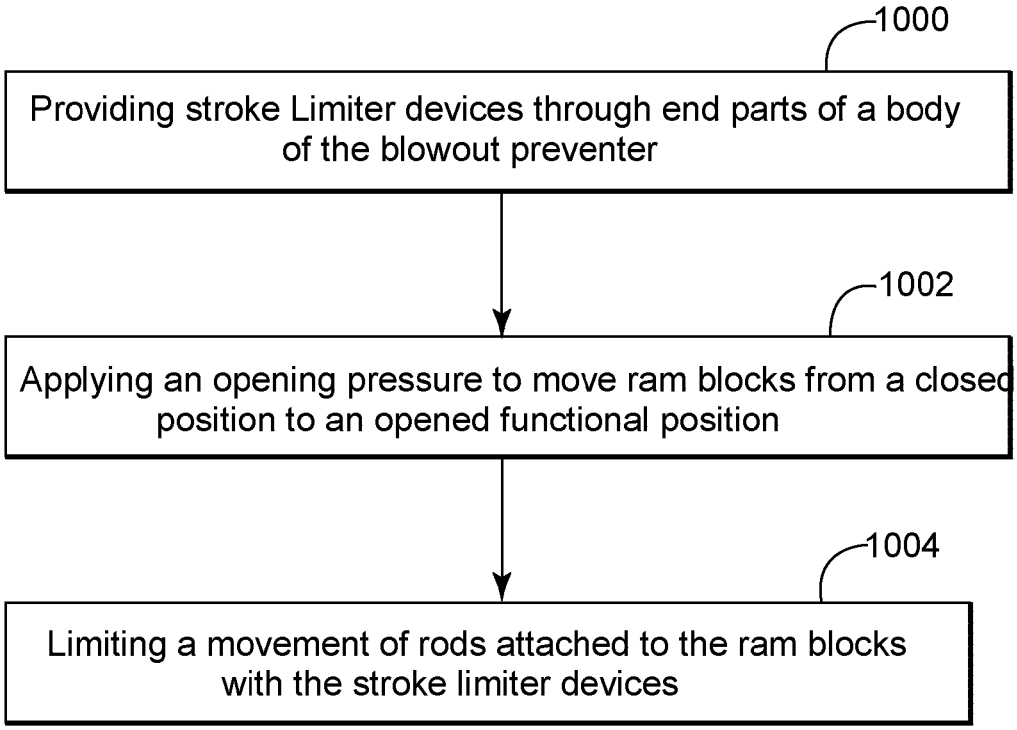
FIG. 9 is a flow chart illustrating a method for limiting a stroke of a ram block in a BOP according to an exemplary embodiment.

According to an exemplary embodiment illustrated in FIG. 9, there is a method for reducing a stroke of a blowout preventer for sealing a well. The method includes a step 1000 of providing stroke limiting devices through end parts of a body of the blowout preventer, a step 1002 of applying an opening pressure to move ram blocks from a closed position to an opened functional position, and a step 1004 of limiting a movement of rods attached to the ram blocks with the stroke limiting devices such that the ram blocks do not reach an opened maintenance position, which is used to open bonnets of the blowout preventer for reaching the ram blocks.

The disclosed exemplary embodiments provide a BOP system and a method for reducing a stroke of a ram block inside the BOP. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A blowout preventer for sealing a well, the blowout preventer comprising:

a body having first and second chambers, the first chamber extending substantially perpendicular to and intersecting the second chamber;

first and second ram blocks configured to move within the first chamber to seal a first region of the second chamber from a second region of the second chamber;

first and second rods connected to the first and second ram blocks, respectively, and configured to extend along the first chamber;

first and second bonnets partially covering first and second rods, respectively, the bonnets being detachably attached to the body; and first and second stroke limiting devices configured to pierce through end parts of the first and second bonnets and to limit a stroke of the first and second rods by a predetermined amount.

2. The blowout preventer of claim 1, wherein a length of the first and second stroke limiting devices inside the first and second bonnets is adjustable.

3. The blowout preventer of claim 2, wherein the first and second stroke limiting devices are adjustable from outside the body.

4. The blowout preventer of claim 2, wherein the first and second stroke limiting devices are manually adjustable from outside the body.

5. The blowout preventer of claim 2, wherein the first and second stroke limiting devices are hydraulically adjustable.

6. The blowout preventer of claim 1, further comprising:

a seal provided around each of the first and second stroke limiting devices such that a working fluid provided inside the body does not escape outside the body.

7. The blowout preventer of claim 1, wherein the first and second stroke limiting devices, when limiting a stroke of the first and second ram blocks, prevent an opening of the first and second bonnets.

8. The blowout preventer of claim 1, further comprising:

an opening chamber and a closing chamber in each of the first and second bonnets; and a piston in each of the first and second bonnets separating corresponding opening and closing chambers and configured to be fixedly attached to a corresponding rod of the first and second rods such that when a differential pressure between the corresponding opening chamber and the corresponding closing chamber is positive the piston moves integrally with the corresponding rod to open the corresponding ram block and when the differential pressure is negative, the piston moves integrally with the corresponding rod to close the corresponding ram block, wherein an opened functional position of the ram blocks is defined by the corresponding rod being in contact with the corresponding stroke limiting device.

9. The blowout preventer of claim 8, wherein an opened maintenance position of the ram blocks, which is different from the opened functional position, is defined by the stroke limiting devices being further retracted from the first and second bonnets to permit the first and second ram blocks to be further opened.

10. The blowout preventer of claim 9, wherein a difference between (i) the opened functional position of the ram blocks and (ii) the opened maintenance position of the ram blocks is between about 10% and 20% of the opened maintenance position of the ram blocks.

11. A blowout preventer for sealing a well, the blowout preventer comprising:

a body having first and second chambers, the first chamber extending substantially perpendicular to and intersecting the second chamber;

first and second ram blocks configured to move within the first chamber to seal a first region of the second chamber from a second region of the second chamber;

first and second rods connected to the first and second ram blocks, respectively, and configured to extend along the first chamber;

first and second bonnets partially covering the first and second rods, respectively, the first and second bonnets being detachably attached to the body;

first and second stroke limiting devices configured to pierce through end parts of the first and second bonnets and limit a stroke of the first and second rods by a predetermined amount;

an opening chamber and a closing chamber in each of the first and second bonnets; and a piston in each of the first and second bonnets separating corresponding said opening and closing chambers and configured to be fixedly attached to a corresponding rod of the first and second rods such that when a differential pressure between the corresponding opening chamber and the corresponding closing chamber is positive the piston moves integrally with the corresponding rod to open the corresponding ram block and when the differential pressure is negative, the piston moves integrally with the corresponding rod to close the corresponding ram block, wherein an opened functional position of the ram blocks is defined by the corresponding rod being in contact with the corresponding stroke limiting device.

12. The blowout preventer of claim 11, wherein a length of the first and second stroke limiting devices inside the first and second bonnets is adjustable.

13. The blowout preventer of claim 12, wherein the first and second stroke limiting devices are manually adjustable from outside the body.

14. The blowout preventer of claim 12, wherein the first and second stroke limiting devices are hydraulically adjustable.

15. The blowout preventer of claim 11, wherein an opened maintenance position of the ram blocks, which is different from the opened functional position, is defined by the stroke limiting devices being further retracted from the first and second bonnets to permit the first and second ram blocks to be further opened.

16. The blowout preventer of claim 15, wherein a difference between (i) the opened functional position of the ram blocks and (ii) the opened maintenance position of the ram blocks is between about 10% and 20% of the opened maintenance position of the ram blocks.

17. The blowout preventer of claim 11, wherein a pressure applied inside the first and second bonnets may be between 5,000 and 15,000 psi.

18. A method for reducing a stroke of a blowout preventer for sealing a well, the method comprising:

providing stroke limiting devices through end parts of bonnets of a body of the blowout preventer;

applying an opening pressure to move ram blocks from a closed position to an opened functional position inside the body; and limiting a movement of rods attached to the ram blocks with the stroke limiting devices such that the ram blocks do not reach an opened maintenance position, which is used to open the bonnets of the blowout preventer for reaching the ram blocks.

19. The method of claim 18, further comprising:

adjusting the stroke limiting devices to adjust an opened functional position of the ram blocks.

20. The method of claim 18, further comprising:

further retracting the stroke limiting devices from the bonnets to permit the ram blocks to be further opened, which defines the opened maintenance position of the ram blocks, such that bonnets of the blowout preventer are allowed to be opened.

* * * * *